US005844766A

United States Patent [19]

Miglioli

[11] Patent Number: 5,844,766

[45] Date of Patent: Dec. 1, 1998

[54] LIGHTNING SUPRESSION SYSTEM FOR TOWER MOUNTED ANTENNA SYSTEMS

[75] Inventor: Lorenzo Miglioli, Piacenza, Italy

[73] Assignee: Forem S.r.l., Agrate Brianza, Italy

[21] Appl. No.: 925,696

[22] Filed: Sep. 9, 1997

[51] Int. Cl.[6] ..... H01C 7/12

[52] U.S. Cl. ..... 361/119; 361/113; 333/12; 333/206; 333/126

[58] Field of Search ..... 361/113, 117–119, 361/126; 333/12, 126, 206

[56] References Cited

U.S. PATENT DOCUMENTS 4,985,800 1/1991 Feldman et al. ..... 361/113

*Primary Examiner*—Jeffrey A. Gaffin
*Assistant Examiner*—Michael J. Sherry
*Attorney, Agent, or Firm*—Laff, Whitesel, Conte & Saret, Ltd.

[57] ABSTRACT

A lightning suppression system comprising a directional coupler, a quarter-wavelength stub, a first cylindrical capacitor, a second cylindrical capacitor and a lightning suppression circuit. Each of the cylindrical capacitors has an inner conductor element, an outer conductive tube and a dielectric material. Direction coupler acts to block direct current and low frequency signals from passing therethrough. The quarter-wavelength stub comprises a helicoid and acts to reflect radio frequency signals back to the transmission line while allowing direct current and low frequency signals to flow therethrough. First cylindrical capacitor and second cylindrical capacitor combine to form a low pass filter which allows direct current and low frequency signals to flow through while blocking other signals. The lightning suppression circuit suppresses high voltage direct current and low frequency signals such as those produced by near lightning strikes.

23 Claims, 4 Drawing Sheets

LIGHTNING SUPRESSION SYSTEM FOR TOWER MOUNTED ANTENNA SYSTEMS

BACKGROUND OF THE INVENTION

This invention is related generally to lightning suppression systems for protecting tower mounted devices in an antenna system from high voltage current surges on a transmission line, such as those resulting from lightning strikes.

Of immediate concern in designing antenna systems having tower mounted components, such as amplifiers, is the need for lightning suppression systems for protecting the tower mounted components from high voltage current surges due to lightning strikes and the like. However, present lightning suppression systems are typically too large and complicated to be conveniently placed near or with the tower mounted components. Furthermore, many present lightning suppression systems produce excessive insertion loss and intermodulation distortion which adversely effects the performance of the antenna system.

Accordingly, a need arises for a compact, reliable lightning suppression system which protects tower mounted devices in an antenna system from high voltage current surges on a transmission line without adversely effecting the performance of the antenna system.

SUMMARY OF THE INVENTION

These needs and others are satisfied by the compact lightning suppression system of the present invention. The lightning suppression system of the present invention couples to a transmission line and suppresses high voltage current surges on the transmission line without significantly affecting the transmission of desired RF signals.

A lightning suppression system according to the present invention comprises a directional coupler, a quarter-wavelength stub, two cylindrical capacitors and a lightning suppression circuit. The directional coupler connects in series with the transmission line for blocking direct current and low frequency signals from passing through the directional coupler. The quarter-wavelength stub is coupled to the transmission line. The quarter-wavelength stub separates direct current and low frequency signals from the desired RF signals on the transmission line by reflecting the desired RF signals back to the transmission line. The cylindrical capacitors are coupled to the quarter-wavelength stub. The cylindrical capacitors form a low pass filter for further separating and filtering the desired RF signals. The lightning suppression circuit is coupled to the transmission line through the quarter-wavelength stub and cylindrical capacitors. The lightning suppression circuit shunts high voltage direct current and low frequency signals to ground.

The lightning suppression system is enclosed within a conductive housing. Each cylindrical capacitor comprises an inner conductor, an outer conductive tube and a dielectric sleeve. The inner conductor is disposed within the outer conductive tube and the outer conductive tube is disposed within the dielectric sleeve.

Each inner conductor loosely couples capacitively with the conductive housing to form a quarter-wavelength, high-impedance, series RF, open-circuit section which reflects the desired RF signals while passing through direct current and low frequency signals. Each outer conductive tube capacitively couples tightly with the conductive housing to form a low impedance, RF open-circuited, quarter-wavelength, stub section which reflects back the desired RF signals in an anti-phase manner to suppress the desired RF signals from the DC path while rejecting direct current and low frequency signals. The dielectric sleeve is made of a material, such as polytetrafluoroethylene, which is resistant to high temperatures and prevents high voltage breakdown.

The directional coupler comprises an elongated first conductor, a dielectric tube and an elongated second conductor. The first conductor is capacitively coupled to the second conductor through the dielectric tube. The diameters of the first conductor, second conductor, dielectric tube and the ground conductor are predetermined to impedance match the system to the transmission line. In the preferred embodiment, the dielectric tube is made of a polytetrafluoroethylene material.

In accordance with the present invention, a very compact, highly efficient, low loss lightning suppression system for cellular and PCS RF usage is provided.

Further objects, features and advantages of the present invention will become apparent from the following description and drawings.

DETAILED DESCRIPTION OF THE INVENTION

In accordance with the present invention, a lightning suppression system is described that provides distinct advantages when compared to those of the prior art. The invention can best be understood with reference to the accompanying drawing figures.

Figure 1:
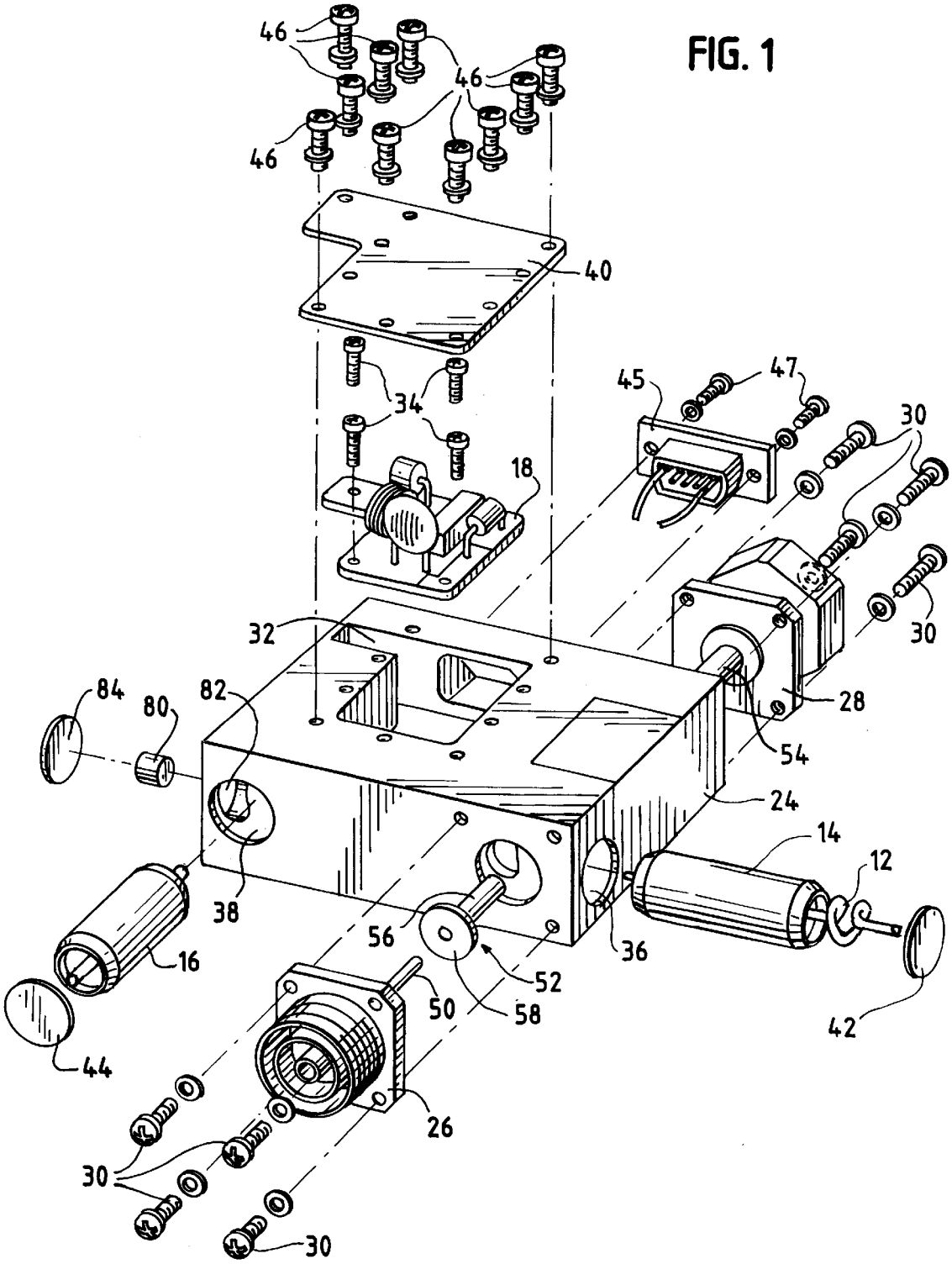
FIG. 1 is an exploded perspective view of a lightning suppression system of the present invention.
Figure 2:
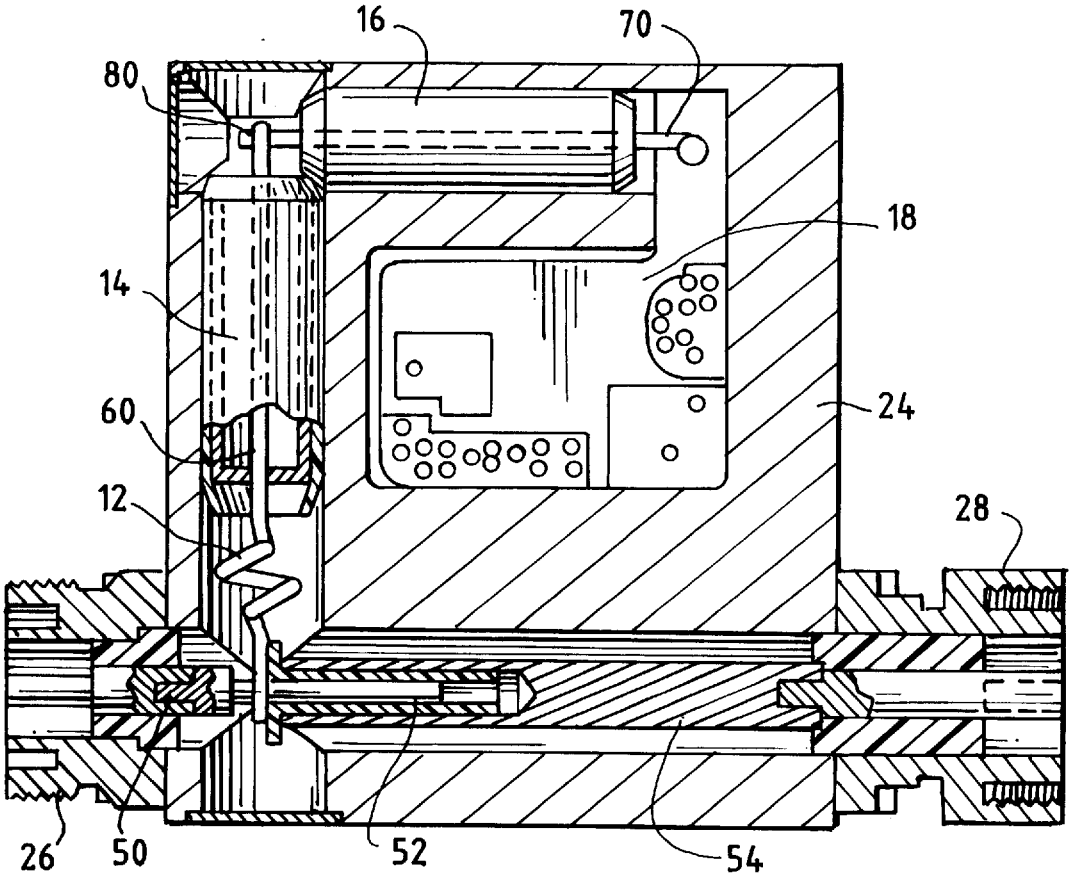
FIG. 2 is a cross-sectional view of the lightning suppression system of FIG. 1.
Figure 3:
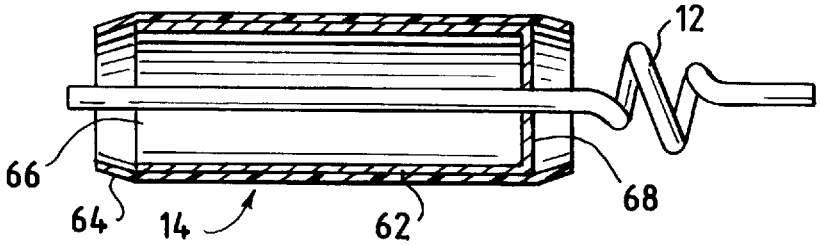
FIG. 3 is a cross-sectional view of a first cylindrical capacitor of the lightning suppression system of FIG. 1.
Figure 4:
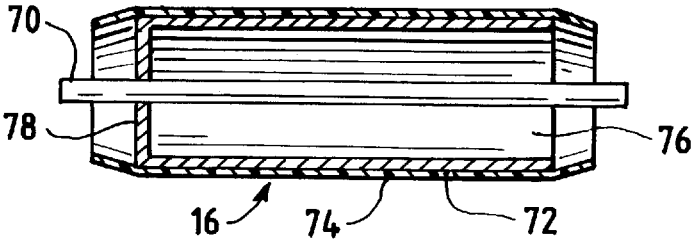
FIG. 4 is a cross-sectional view of a second cylindrical capacitor of the lightning suppression system of FIG. 1.
Figure 5:
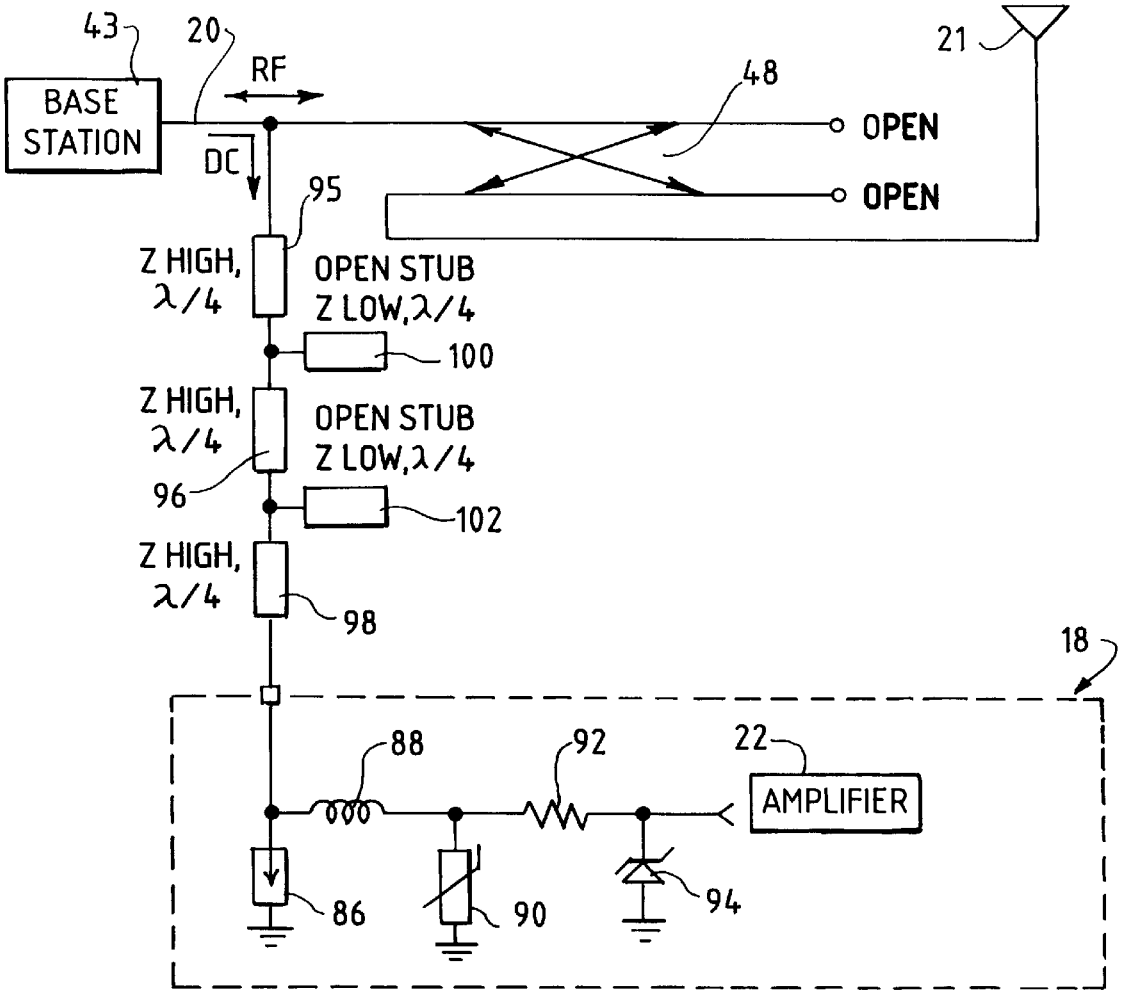
FIG. 5 is a schematic view of the lightning suppression system of FIG. 1.
Figure 6:
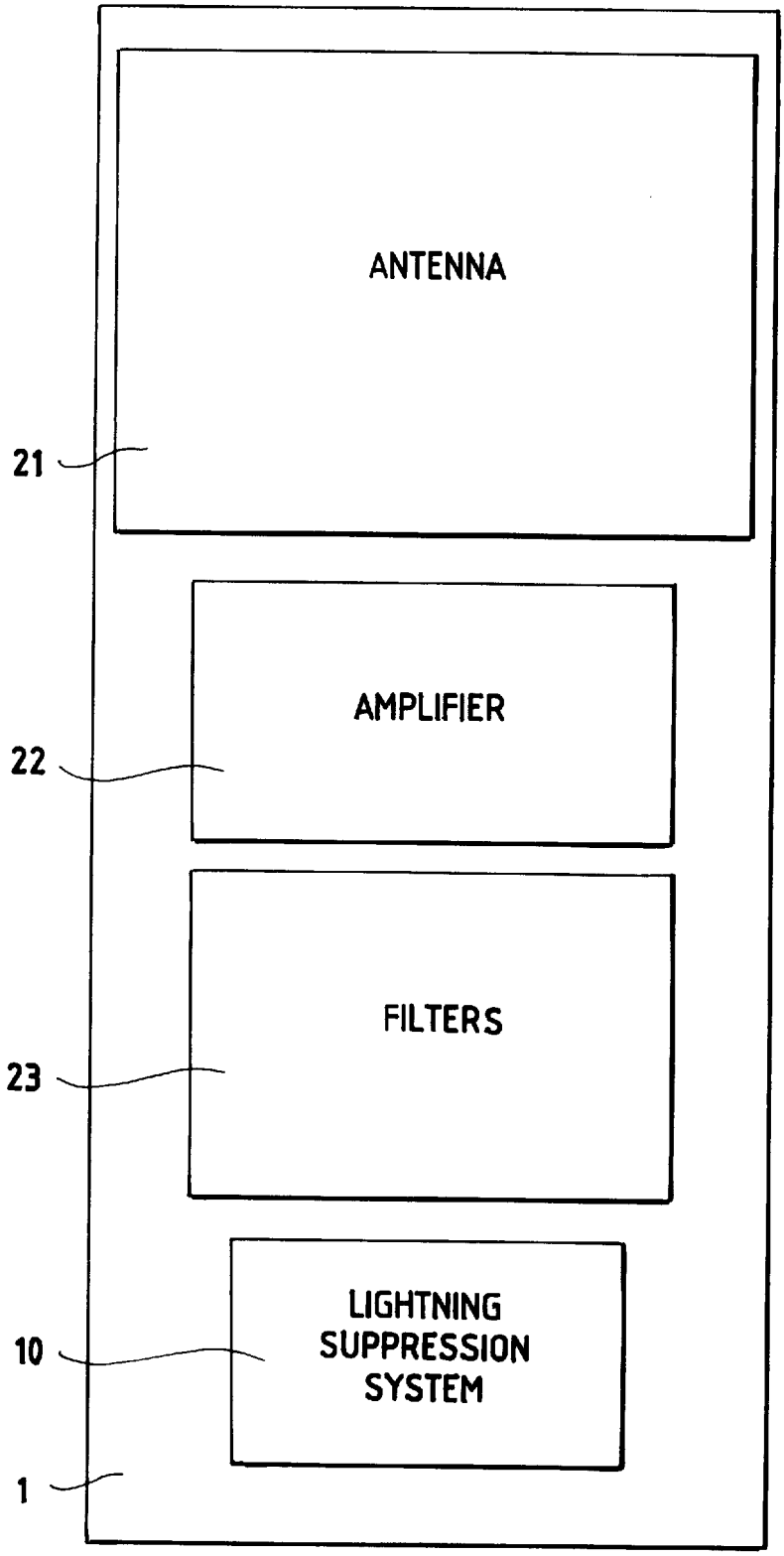
FIG. 6 is a schematic showing of an assemblage including a tower mounted antenna, other tower mounted components and the lightning suppression system of FIG. 1.

Referring first to FIG. 6, a tower mounted antenna system employing the lightning suppression system 10 of the present invention may desirably comprise an antenna 21, such as a conventional panel antenna, one or more amplifiers 22 and other components, such as filters 23, in a suitable housing 1. As illustrated schematically in FIG. 6, the lightning suppression system 10 is compact relative to the other components so that it may easily be added to the antenna system housing 1 without substantially affecting the size, weight and tower mountability of the antenna system itself.

Referring now to FIGS. 1–5, a lightning suppression system, generally indicated at 10, for coupling to a transmission line for suppressing high voltage current surges on the transmission line without affecting the transmission of desired RF signals comprises a quarter-wavelength stub 12, a first cylindrical capacitor 14 and a second cylindrical capacitor 16 for coupling a lightning suppression circuit 18 to the transmission line 20 of a tower mounted antenna 21 for protecting a tower mounted antenna system component, such as the tower mounted amplifier 22 and filters 23. Lightning suppression system 10 is housed in a protective housing 24 which includes a pair of connectors 26 and 28 connecting transmission line 20 to the lightning suppression system 10. Connectors 26 and 28 are fastened to housing 24, as by a plurality of suitable fasteners, such as threaded fasteners 30.

In the preferred embodiment, the desired RF frequency range is 1850–2000 MHz. All dimensions disclosed herein are specifically determined to operate in this frequency range. For systems designed to operate in other frequency ranges, the dimensions would obviously be different.

The housing 24 is made of a conductive material, such as silver plated aluminum, and is 4.000×3.531×1.370 inches in size. Housing 24 includes cavities for various of the lightning suppression system components. Lightning suppression circuit 18 is disposed and enclosed in suppression circuit cavity 32 and is held in place by suitable fasteners 34. First cylindrical capacitor 14 is disposed and enclosed in first capacitor cavity 36 and second cylindrical capacitor 16 is disposed and enclosed in second capacitor cavity 38. Brass covers 40, 42 and 44 cover cavities 32, 36 and 38, respectively. Cover 40 is held in place by suitable fasteners 46, while covers 42 and 44 screw into threads in cavities 36 and 38, respectively.

A connector 45 for amplifier 22 is also provided for connecting amplifier 22 to lightning suppression system 10. Connector 45 is connected to the output of lightning suppression circuit 18 and is secured to housing 24 by suitable fasteners 47.

In the preferred embodiment, transmission line 20 is a shielded coaxial cable and connectors 26 and 28 are standard coaxial connectors. Connectors 26 and 28 are connected together by a directional coupler 48 (see FIG. 5), comprising an elongated first conductor 50, a dielectric tube 52 and an elongated second conductor 54 (see FIG. 1).

First conductor 50 and second conductor 54 are electrically connected to the center conductor of coaxial transmission line 20 by connectors 26 and 28. First conductor 50 and second conductor 54 are capacitively coupled together by dielectric tube 52.

In a preferred embodiment, first conductor 50 comprises a conductive rod, such as a brass rod. Dielectric tube 52 comprises a hollow polytetrafluroethylene tube 56 having an end flange 58. Second conductor 54 comprises a hollow conductive rod, such as a brass rod. Hollow polytetrafluroethylene tube 56 is configured to receive first conductor 50. The hollow second conductor 54 is configured to receive-dielectric tube 52.

Thus, a capacitive coupling is created between first conductor 50 and second conductor 54. The capacitive coupling between first conductor 50 and second conductor 54 prevents direct current and low frequency signals from passing between first conductor 50 and second conductor 54, while allowing radio frequency signals to be passed therebetween. Connector 26 is connected to the base station 43 with directional coupler 48 allowing low power direct current to flow from the base station 43 to the tower mounted amplifier 22. Connector 28 is connected to the antenna 21 with directional coupler 48. The diameters of first conductor 50, second conductor 54, dielectric tube 52 and the ground conductor (not shown) are predetermined so as to provide impedance matching between lightning suppression system 10 and transmission line 20.

First cylindrical capacitor 14 comprises an inner conductor element 60, an outer conductive tube 62 and a dielectric sleeve 64. Inner conductor element 60 comprises a conventional conductor, such as 12-gage copper wire. Outer conductive tube 62 comprises a hollow tube made of conductive material, such as silver plated aluminum, having an open end 66 and a closed end 68. In the preferred embodiment, dielectric sleeve 64 is made of a dielectric material, such as polytetrafluroethylene, which is resistant to high temperatures and to high voltages.

Inner conductor element 60 is positioned inside of outer conductive tube 62 and is electrically connected, such as by solder, to outer conductive tube 62 at closed end 68. Air fills the space between inner conductor element 60 and outer conductive tube 62. Dielectric sleeve 64 surrounds outer conductive tube 62 extending past both ends 66 and 68. Inner conductor element 60 and outer conductive tube 62 are each approximately a quarter-wavelength in length. In the preferred embodiment, first cylindrical capacitor 14 is 2.067 inches in length, outer conductive tube 62 is 1.299 inches in length and 0.353 inches in diameter, dielectric sleeve 64 extends 0.157 inches past each end of outer conductive tube 62 and inner conductor element 60 extends 0.275 inches from closed end 68.

In the preferred embodiment, quarter-wavelength stub 12 comprises an extension of inner conductor element 60. The extension is in the form of a helicoidal section which electrically connects first cylindrical capacitor 14 to first conductor 50. Preferably, the helicoidal section is 0.630 inches in length and comprises a single turn 0.236 inches in length and 0.43 inches in diameter. The helicoidal section both assists in providing a compact suppression system and functions as an inductance in the low pass filter.

Second cylindrical capacitor 16 comprises an inner conductor element 70, an outer conductive tube 72 and a dielectric sleeve 74. Inner conductor element 70 comprises a conventional conductor, such as 12-gage copper wire. Outer conductive element 72 comprises a hollow tube made of conductive material, such as silver plated aluminum, having an open end 76 and a closed end 78. In the preferred embodiment, dielectric sleeve 74 is made of a dielectric material, such as polytetrafluroethylene, which is resistant to high temperatures and to high voltages.

Inner conductor element 70 is positioned inside of outer conductive tube 72 and is electrically connected, such as by solder, to outer conductive tube 72 at closed end 78. Air fills the space between inner conductor element 70 and outer conductive tube 72. Dielectric sleeve 74 surrounds outer conductive tube 72 extending past both ends 76 and 78. Inner conductor element 70 and outer conductive tube 72 are each approximately a quarter-wavelength in length. In the preferred embodiment, second cylindrical capacitor 16 is 2.067 inches in length, outer conductive tube 72 is 1.299 inches in length and 0.353 inches in diameter, dielectric sleeve 74 extends 0.157 inches past each end of outer conductive tube 72 and inner conductor element 70 extends 0.275 inches from closed end 78.

Second cylindrical capacitor 16 is connected to first cylindrical capacitor 14 in series via conductor solder clip 80. Inner conductor element 72 of second cylindrical capacitor 16 is connected to inner conductor element 62 of first cylindrical capacitor 14 such that second cylindrical capacitor 16 is positioned substantially perpendicular to first cylindrical capacitor 14 in housing 24. Conductor solder clip 80 is placed inside housing 24 via solder clip opening 82, which is covered by solder clip cover 84. Lightning suppression circuit 18 is electrically connected to inner conductor element 70 of second cylindrical capacitor 16 on an end opposite the connection to first cylindrical capacitor 14.

In a preferred embodiment, lightning suppression circuit 18 comprises a gas discharge tube 86, an inductor element 88, a varistor 90, a resistor element 92 and a zener diode 94. Gas discharge tube 86 and inductor element 88 are connected to second cylindrical capacitor 16. Varistor 90 and resistor element 92 are connected to inductor element 88. Zener diode 94 and amplifier 22 are connected to resistor element 92. Other prior art lightning suppression circuits may be used as well.

In operation, quarter-wavelength stub 12 is coupled to the transmission line 20 for separating direct current and low frequency signals from the desired radio frequency signals traveling on the transmission line 20. First cylindrical capacitor 14 and second cylindrical capacitor 16 combine to form a low pass filter which is coupled to the stub 12 and which allows direct current and low frequency signals to pass therethrough while reflecting other signals, thereby further separating and filtering the desired RF signals. Lightning suppression circuit 18 shunts harmful high voltage direct current and low frequency signals to ground while allowing low voltage direct current power supply for the tower mounted components to reach and power those components.

Helicoidal quarter-wavelength stub 12, if straightened, is one-quarter wavelength in length. Quarter-wavelength stub 12 acts as a high-impedance, open-circuit section 95 for the radio frequency signals by capacitively coupling with housing 24. In doing so, quarter-wavelength stub 12 reflects the radio frequency signals back to the transmission line 20 in phase.

Cylindrical capacitor 14 comprises a quarter-wavelength, high-impedance, series RF, open-circuit section 96 and a low impedance, RF open-circuited section 100. Cylindrical capacitor 16 comprises a quarter-wavelength, high-impedance, series RF, open-circuit section 98 and a low impedance, RF open-circuited section 102. Each of the high impedance, series RF, open-circuit sections 96 and 98 separately acts to reflect desired RF signals back toward transmission line 20 while passing through all direct current and low frequency signals. Each low-impedance, RF open-circuited section 100 and 102 acts to reflect the desired RF signals, while rejecting all direct current and low frequency signals.

High-impedance, series RF, open-circuit section 96 of first cylindrical capacitor 14 is realized by the "loose" capacitive coupling created between inner conductor element 60 and housing 24 when first cylindrical capacitor 14 is enclosed in housing 24. Low-impedance, RF open-circuited section 100 of first cylindrical capacitor 14 is realized by the "tight" capacitive coupling created between outer conductive tube 62 and housing 24.

Similarly, high-impedance, series RF, open-circuit section 98 of second cylindrical capacitor 16 is realized by the "loose" capacitive coupling created between inner conductor element 70 and housing 24 when second cylindrical capacitor 16 is enclosed in housing 24. Low-impedance, RF open-circuited section 102 of second cylindrical capacitor 16 is realized by the "tight" capacitive coupling created between outer conductive tube 72 and housing 24.

Each cylindrical capacitor 14 and 16 of the present invention actually comprises a capacitor within a capacitor. Both a high-impedance, series RF, open-circuit section and a low impedance, RF open-circuited section can be realized by a single cylindrical capacitor. Thus, valuable space is saved allowing the lightning suppression system 10 of the present invention to be adaptable to tower mounted applications where space is at a premium. Space is also saved by employing helicoidal quarter-wavelength stub 12, further facilitating adaptation to tower mounted applications. Furthermore, by packaging the system 10 with the second cylindrical capacitor 16 perpendicular to the first cylindrical capacitor 14 additional reduction in system size is possible.

The design and packaging of the lightning suppression system 10 of the present invention allows it to be integrated into an antenna system with a minimum number of connectors and solder joints. Furthermore, both the first cylindrical capacitor 14 and the second cylindrical capacitor 16 use conductors having a relatively large diameter, such as 12-gage copper wire. Thus, the lightning suppression system 10 of the present invention has an extremely low insertion loss providing performance improvements over prior art lightning suppression systems.

It will be apparent to those skilled in the art that modifications may be made without departing from the spirit and scope of the invention. Accordingly, it is not intended that the invention be limited except as may be necessary in view of the appended claims.

What is claimed is:

1. A lightning suppression system for coupling to a transmission line for suppressing high voltage current surges on the transmission line without affecting the transmission of desired RF signals, the suppression system comprising:

a quarter-wavelength stub for coupling to said transmission line for separating direct current and low frequency signals from said desired RF signals on the transmission line;

a low pass filter coupled to said quarter-wavelength stub and for further separating and filtering said desired RF signals, said low pass filter comprising at least one cylindrical capacitor having a low-impedance, RF open-circuited section and a high-impedance, series RF, open-circuit section; and a lightning suppression circuit for coupling to the transmission line through said quarter-wavelength stub and said low pass filter, and for shunting high voltage direct current and low frequency signals.

2. The system of claim 1 further comprising a directional coupler for series connection with the transmission line for blocking direct current and low frequency signals from passing through said directional coupler.

3. The system of claim 1 wherein said low pass filter comprises at least two cylindrical capacitors.

4. The system of claim 1 wherein said quarter-wavelength stub is formed as a helicoid for reflecting said desired RF signals back to the transmission line in phase.

5. The system of claim 3 further comprising a housing and wherein said quarter-wavelength stub and each said cylindrical capacitor is enclosed within said housing.

6. The system of claim 5 wherein each said cylindrical capacitor comprises an inner conductor element disposed within an outer conductive tube, and a dielectric sleeve surrounding said outer conductive tube.

7. The system of claim 6 wherein said housing comprises a conductive housing and each said inner conductor element loosely couples capacitively with said conductive housing to form a high-impedance, series RF, open-circuit and each said outer conductive tube capacitively couples tightly with said conductive housing to form a low-impedance, RF open-circuit.

8. The system of claim 3 wherein each said cylindrical capacitor has a low-impedance, RF open-circuited section and a high-impedance, series RF, open-circuit section, wherein said low-impedance, RF open-circuited section reflects said desired RF signal back to the transmission line in an anti-phase manner while rejecting said direct current and low frequency signals and wherein said high-impedance, series RF, open-circuit section reflects said desired RF signals while passing through said direct current and low frequency signals.

9. The system of claim 2 wherein said directional coupler comprises an elongated first conductor, a dielectric tube and an elongated second conductor, wherein said first conductor is capacitively coupled to said second conductor through said dielectric tube.

10. The system of claim 6 wherein said dielectric sleeve is formed of a material which is resistant to high temperatures and prevents high voltage breakdown.

11. The system of claim 9 wherein the diameters of said first conductor and said second conductor are predetermined to impedance match said system to the transmission line.

12. The system of claim 10 wherein said dielectric sleeve comprises a polytetrafluoroethylene sleeve.

13. The system of claim 9 wherein said dielectric tube comprises a polytetrafluoroethylene connector.

14. A lightning suppression system for coupling to a transmission line for suppressing high voltage current surges on the transmission line without affecting the transmission of desired RF signals, the suppression circuit comprising:

a directional coupler for series connection with the transmission line for blocking direct current and low frequency signals from passing through said directional coupler;

a helicoidal quarter-wavelength stub for coupling to said transmission line for separating direct current and low frequency signals from said desired RF signals on the transmission line by reflecting said desired RF signals back to the transmission line in phase;

at least two cylindrical capacitors coupled to said helicoidal quarter-wavelength stub, said capacitors forming a low pass filter for further separating and filtering said desired RF signals;

a lightning suppression circuit for coupling to said transmission line through said helicoidal quarter-wavelength stub and said cylindrical capacitors and for shunting high voltage direct current and low frequency signals.

15. The system of claim 14 further comprising a housing and wherein said quarter-wavelength stub and each said cylindrical capacitor is enclosed within said housing.

16. The system of claim 15 wherein each said cylindrical capacitor comprises an inner conductor element disposed within an outer conductive tube and a dielectric sleeve surrounding said outer conductive tube.

17. The system of claim 16 wherein said housing comprises a conductive housing and each said inner conductor element loosely couples capacitively with said conductive housing to form a high-impedance, series RF, open-circuit section, wherein said high-impedance, series RF, open-circuit section reflects said desired RF signals while passing through said all direct current and low frequency signals.

18. The system of claim 15 wherein said housing comprises a conductive housing and each said outer conductive tube capacitively couples tightly with said conductive housing to form a low-impedance, RF open-circuited section, wherein said low-impedance, RF open-circuited section reflects said desired RF signals in an anti-phase manner while rejecting said all direct current and low frequency signals.

19. The system of claim 14 wherein said directional coupler comprises an elongated first conductor, a dielectric tube and an elongated second conductor, wherein said first conductor is capacitively coupled to said second conductor through said dielectric tube.

20. The system of claim 16 wherein said dielectric sleeve is formed of a material which is resistant to high temperatures and prevents high voltage breakdown.

21. The system of claim 19 wherein the diameters of said first conductor and said second conductor are predetermined to impedance match said system to the transmission line.

22. The system of claim 20 wherein said dielectric sleeve comprises a polytetrafluoroethylene sleeve.

23. The system of claim 19 wherein said dielectric tube comprises a polytetrafluoroethylene connector.

* * * * *

UNITED STATES PATENT AND TRADEMARK OFFICE

CERTIFICATE OF CORRECTION

PATENT NO. : 5,844,766
DATED : December 1, 1998
INVENTOR(S) : Miglioli, et al.

It is certified that error appears in the above-indentified patent and that said Letters Patent is hereby corrected as shown below:

On the title page, and Column 1,

[54] delete "SUPRESSION" and insert --SUPPRESSION--

[75] Inventor: add

--Silvia Cavalieri D'Oro, Monza, Italy;
Massimo Rivolta, Agrate Brienza, Italy--

[19] should read --Miglioli et al.--

Signed and Sealed this

Thirteenth Day of July, 1999

*Attest:*

*Attesting Officer*

Q. TODD DICKINSON

*Acting Commissioner of Patents and Trademarks*